United States Patent [19]

Schutte

[11] 3,997,287

[45] Dec. 14, 1976

[54] GAS BURNER

[75] Inventor: Hendrik Schutte, Kampen, Netherlands

[73] Assignee: Air-O-Burner BV, Netherlands

[22] Filed: Jan. 8, 1975

[21] Appl. No.: 539,505

[30] Foreign Application Priority Data

Jan. 16, 1974 Netherlands ..... 7400603

[52] U.S. Cl. ..... 431/355; 239/431; 239/568; 239/601

[51] Int. Cl.[2] ..... F23D 13/36

[58] Field of Search ..... 431/354, 355; 239/568, 239/601, 429–431

[56] References Cited

UNITED STATES PATENTS

| | | | |
|---|---|---|---|
| 3,288,377 | 11/1966 | Van De Roer | 239/568 |
| 3,506,198 | 4/1970 | Van Der Zwaal | 431/354 |

FOREIGN PATENTS OR APPLICATIONS

| | | | |
|---|---|---|---|
| 442,659 | 6/1912 | France | 239/568 |
| 1,309,290 | 10/1962 | France | 239/601 |
| 1,439,735 | 4/1966 | France | 239/568 |
| 1,216,815 | 5/1966 | Germany | 239/568 |

*Primary Examiner*—Carroll B. Dority, Jr.
*Attorney, Agent, or Firm*—Wilkinson, Mawhinney & Theibault

[57] ABSTRACT

Gas burner which is constructed of a connecting part in which the gas is mixed with primary air and of an outflow part of sheet material, with a number of annularly arranged and radially directed slits folded into a star-shaped configuration in which the height H of the star-shaped folds is a multiple of the radial dimension R of these folds, while the cross sectional area of each slit is larger near the circumference of the ring than in the center.

3 Claims, 7 Drawing Figures

GAS BURNER

DISCUSSION OF THE PRIOR ART

My invention relates to a gas burner which is constructed of a connecting part in which the gas is mixed with primary air and of an outflow part of sheet material, folded into a star-shaped configuration, by which a number of annularly arranged and substantially radially directed slits are formed. An example of such a burner is described in the German Patent Specification No. 1.216.815.

BACKGROUND OF THE INVENTION

Recent developments concerning compact, very efficient heat transfer units have given rise to a growing need for a a very efficient circular burner which can take loads up to 1600 kilowatt per $m^2$ burner face or even higher.

So far attempts have been made to meet these requirements in various ways. A first attempt is that the quantity of primary air is increased, which, however, present the disadvantage that a very high flame temperature is produced, whereby owing to radiation and convection the adjacent parts of the heat transfer unit (e.g. air heater) are being impaired. Moreover, resonance noises may occur.

A second attempt is to increase the specific load of the burner gate by a so-called auxiliary gas structure, which should prevent the flame from detaching itself from the upper end of the burner and thereby extinguishing the former. A disadvantage of the above is, however, a more expensive construction, disturbing noises and a less satisfactory regulability.

SUMMARY OF THE INVENTION

My invention aims to provide a solution for these problems by using a rather great burner surface from which the gas pre-mixed to a value ranging from 30% to 45% streams out with a laminar flow without any special aid. This is attained by the arrangement that the height of the star-shaped folds is a multiple of the radial dimension of these folds and that the cross sectional surface of each slit in the vicinity of the circumference of the ring-shaped configuration is larger than in the centre.

In this manner a maximum of washed surface with a minimum of cross section is obtained, whereby the greater part of the gas streams out in the outer area of the star-shaped slits, that is to say in the area in which the most of the secondary air is available. The high and narrow slits ensure a laminar flow and no lateral fanning of the flame occurs. The slits in the known burners open all radially outwardly, so that also the gas flow will diverge.

According to a preferred embodiment of a gas burner a narrow zone transverse to the direction of flow is provided in each slit and in an area slightly spaced from the outflow opening. Due to this narrow zone, which on deforming the sheet can be easily impressed, is ensured that no back drag of the flame toward the connecting part (the injection piece) will occur. Secondly such a pressure distribution can be obtained in the base of the flame that the individual flames hinder each other in the least possible manner so that the star-shaped slits can be brought close to each other. This means a possibility for a great number of folds and therefore a great number of slits, whereby a high load is feasable.

According to an embodiment each slit can be shaped with laterally directed branches. Consequently the gas passage is enlarged and a corresonding increase of the burner load can be obtained in this manner.

It should be noted that the burner according to the invention is particularly adapted for use in an air heater of the type described in U.S. Pat. No. 3,820,526.

SURVEY OF THE DRAWINGS

DESCRIPTION OF PREFERRED EMBODIMENTS

Figure 1:
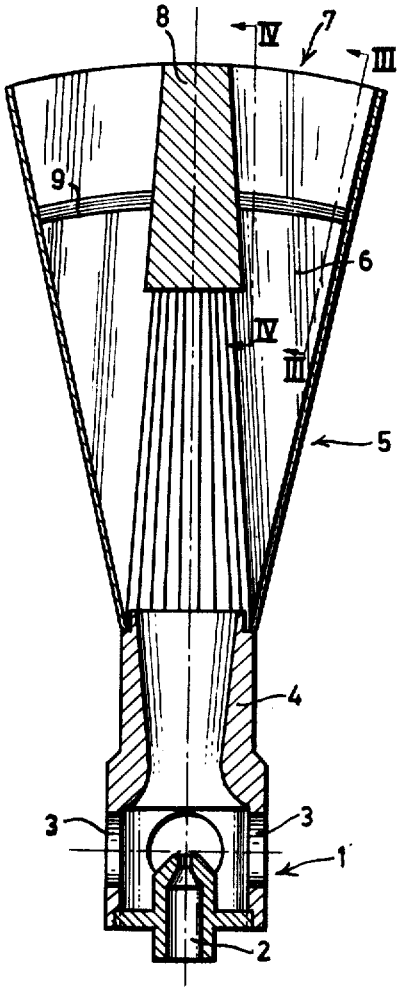
FIG. 1 is a longitudinal section through the burner.

As is best seen in FIG. 1 the burner is constructed of a connecting part or injection piece 1 with a gas inlet 2 and apertures 3 through which primary air can enter. A venturi part 4 is connected to piece 1 and an outflow part 5 of sheet material folded such that it takes a star-shaped configuration is secured to part 4. A great number of radially directed slits 6 are formed in this part 5. At the upper end are burner gates 7 which adjoin a central common fixing means 8.

Figure 3:
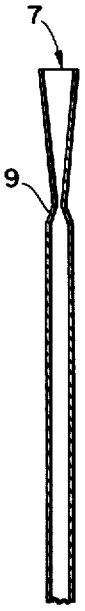
FIG. 3 and FIG. 4 represent a section according to line III—III, IV—IV respectively, in FIG. 1.
Figure 4:
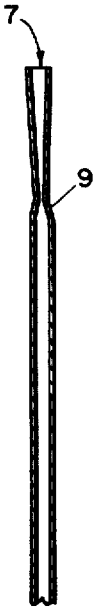

The height H of the star-shaped folds 5 is a multiple of the radial dimension R of these folds. The cross sectional surface of each slit 6 is near the circumference of the ring greater than in the centre. This fact is best seen in the sections shown FIGS. 3 and 4. It is furthermore of importance that in each slit 6 a narrow zone 9 is provided, transverse to the direction of flow, in an area at some distance from the outflow opening or burner gate 7. This narrow zone 9 causes a local decrease of the cross sectional surface, amounting from about 75% in the proximity of the circumference of the slit 6 (see FIG. 3) to about 50% in the vicinity of the centre (see FIG. 4).

Figure 2:
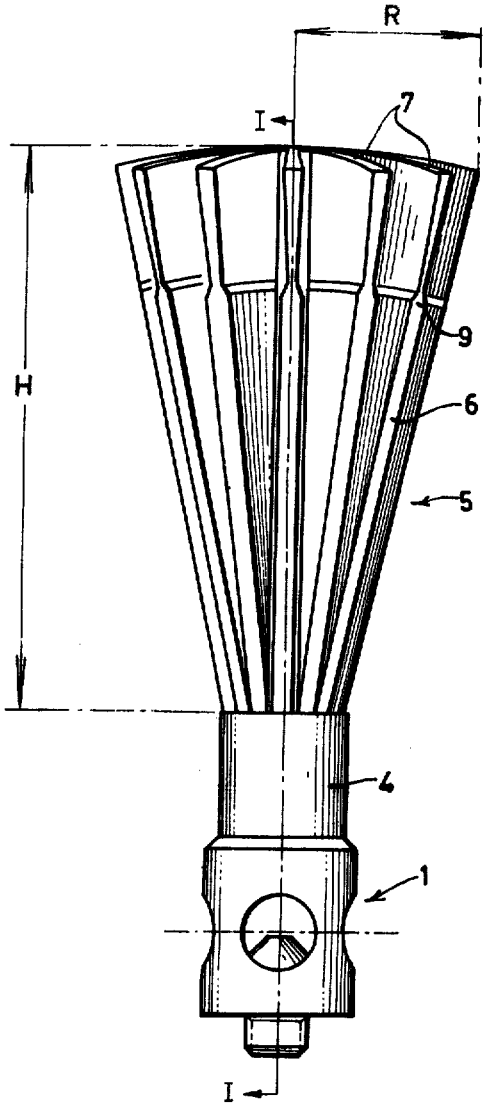
FIG. 2 is a side elevation of the burner according to FIG. 1.

The outflow part 5 folded into a star-shaped configuration is manufactured from a flat sheet in which exclusively by means of a folding formation a burner head, as shown in FIGS. 1 and 2, is formed. In this embodiment there are twelve folds arranged in a star-shaped configuration. Between these many folds the secondary air can easily flow in, while further the outwardly diverging shape of the burner gate 7 is favourable for obtaining an efficient high load of this burner.

Figure 5:
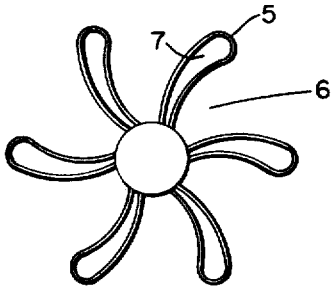
FIGS. 5 to 7 are plan views of three modifications of the embodiment according to FIGS. 1 and 2.
Figure 6:
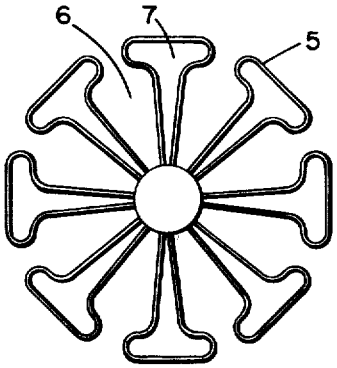
Figure 7:
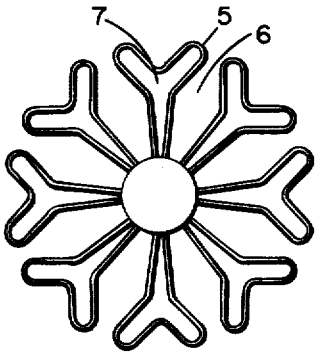

In FIGS. 5 to 7 some other modifications are shown in plan view. The folds 5 and the slits 6 may have an arcuate shape (FIG. 5) so that in this manner the cross sectional area of each slit in the vicinity of the circumference of the ring is greater than in the centre. In FIGS. 6 and 7 each slit 6 is formed with laterally directed branches. The sheet material of such a slit branching may be connected with the wall of an opposite branching of an adjacent slit, in order to increase the strength of the burner.

The advantages of the gas burner according to my invention can be summarized as follows:

Within a limited circular surface a high load up to 1600 kilowatt per $m^2$ and more can be attained;

Since the preliminary mixing is rather moderate, the quantity of mixture is small, so that the surface of the gates 7 can remain small as yet, at a rather low load of the gate. As a consequence there is plenty of space between the folds 5 to allow a maximal passage to the inflowing secondary combustion air;

The burner is protected from an inward striking of the flame and from extinction owing to the so-called blowing off of the flame;

There is no flame mixing and the various slits can be positioned rather close to each other.

What I claim is:

1. A gas burner comprising an injection piece having a gas inlet and apertures through which primary air can enter and an out flow part of sheet material folded into a star-shaped configuration by which means a number of annularly arranged substantially radially directed slits are formed defining a ring wherein the height of the star shape folds is a multiple of the radial dimension of said folds, the cross sectional area of each slit being larger near the circumference of said ring than in the center, and each slit having a narrow zone transverse to the direction of flow spaced from the outflow opening.

2. Gas burner according to claim 1, wherein the narrow zone causes a local decrease of the cross sectional slit amounting from about 75% in proximity of the circumference of the slit to about 50% in the vicinity of the centre.

3. Gas burner according to claim 1, wherein at least ten folds are arranged in a star-shaped configuration.

* * * * *